United States Patent [19]

Hendrix et al.

[11] Patent Number: 4,549,880

[45] Date of Patent: Oct. 29, 1985

[54] SILICONE DURABLE PRESS TEXTILE TREATMENT PROCESS WITH RADIATION CURING AND RESULTING PRODUCT

[75] Inventors: James E. Hendrix, Spartanburg, S.C.; John Y. Daniels, Pineville; Taryn M. White, Charlotte, both of N.C.

[73] Assignee: Springs Industries, Inc., Fort Mill, S.C.

[21] Appl. No.: 529,042

[22] Filed: Sep. 2, 1983

[51] Int. Cl.[4] ..... D06M 13/10

[52] U.S. Cl. ..... 8/115.52; 8/115.6; 8/120; 8/DIG. 1; 8/DIG. 12; 8/DIG. 18

[58] Field of Search ..... 8/115.6, 115.5, DIG. 1, 8/DIG. 12, DIG. 18, 120

[56] References Cited

U.S. PATENT DOCUMENTS 4,269,602 5/1981 Worth et al. ..... 8/115.5
4,269,603 5/1981 Worth ..... 8/115.6

FOREIGN PATENT DOCUMENTS 862635 2/1971 Canada .
1123447 8/1968 United Kingdom .

OTHER PUBLICATIONS

Simpson, *Textile Research Journal*, Feb. 1968, pp. 170–179.

Beninote et al., *American Dyestuff Reporter*, May 28, 1962, pp. 29–33.

Welch et al., *Textile Research Journal*, Apr. 1967, pp. 324–333.

*Primary Examiner*—James C. Cannon

*Attorney, Agent, or Firm*—Bell, Seltzer, Park and Gibson

[57] ABSTRACT

Textile materials containing cellulosic fibers are provided with durable press properties by reacting and crosslinking a silicone compound with the cellulosic fibers. The fabric is impregnated with a finishing bath containing the silicone compound and a suitable catalyst and the fabric is heated to dry and cure and crosslink the finishing composition.

6 Claims, No Drawings

SILICONE DURABLE PRESS TEXTILE TREATMENT PROCESS WITH RADIATION CURING AND RESULTING PRODUCT

FIELD OF THE INVENTION

This invention relates to a process for treating a textile fabric to obtain durable press properties and to the resulting durable press textile fabric.

This invention more particularly relates to a durable press treatment process and treated fabric which use silicone compounds as the durable press finishing agent and which are thus characterized by avoiding the use of formaldehyde or formaldehyde based components.

BACKGROUND OF THE INVENTION

Prior commercial methods for achieving durable press properties in textile fabrics typically have used aminoplast resins, such as glyoxal resin, melamine resin, urons, carbamates and urea formaldehydes as the reactive durable press finishing agents in a treatment process which involves impregnating the fabric with an aqueous solution of the resin, and thereafter drying the fabric and curing and crosslinking the resin. Since these aminoplast resins are all based on formaldehyde, the durable press treatment processes which use these resins result in formaldehyde being evolved from the fabric during the curing operation, and also result in the presence of free formaldehyde in the resulting fabric.

Because of concern over health hazards presented by exposure to formaldehyde, there has been a great deal of recent interest in developing a durable press treatment process which does not involve the use of formaldehyde or formaldehyde based resins and does not result in the presence of formaldehyde in the curing operation or in the resulting fabric. By way of example, recent U.S. patents concerned with nonformaldehyde durable press treatment processes include the following: U.S. Pat. Nos. 4,076,870; 4,116,625; 4,269,602; and 4,269,603.

While these patents disclose various approaches to the elimination of formaldehyde in durable press processing, the processes all have certain limitations or disadvantages which make them undesirable for use on a commercial scale, and hence, insofar as applicants are aware, these processes have not been used commercially to any significant extent. Accordingly, an object of the present invention is to provide a new and improved formaldehyde-free process for obtaining durable press properties in a textile fabric.

The present invention is based upon use of silicone compounds as a durable press agent for producing durable press properties in a textile fabric without the use of formaldehyde or formaldehyde based resins. Silicone polymers have been used heretofore in textile finishing operations as softeners to impart a better hand to the fabric and for imparting water repellent properties. Silicones have also been used in conjunction with aminoplast resins such as those described above in durable press treatment processes as extenders to reduce the amount of aminoplast resin required. Attempts have also been made to use silicone polymers alone for imparting durable press properties to certain types of fabric. Such attempts are disclosed for example in British Pat. No. 1,123,447 and Canadian Pat. No. 862,635. In these prior approaches, silicone polymers are applied to the fabric and cured or vulcanized to form a permanent resilient sheath on the textile fibers. Apparently, the resilient flexible nature of the silicone polymer sheath is intended to enhance the crease recovery of the fibers and thereby impart durable press properties. However, these prior approaches have been unsuccessful in providing a silicone based durable press textile treatment for use on textile fabrics containing cellulosic fibers which is suitable for commercial production using conventional pad-dry-cure techniques.

SUMMARY OF THE INVENTION

In accordance with the present invention, we have discovered how to obtain durable press properties in a textile fabric containing cellulosic fibers with the use of silicone compounds as a durable press finishing agent which react and crosslink with the cellulosic fibers. Consequently, it is now possible to eliminate the use of formaldehyde or formaldehyde-based resins as the reactive durable press finishing agents, and thereby avoid the undesirable odor and potential hazard of formaldehyde vapors in the work environment of the durable press finishing operation and also avoid the presence of formaldehyde on the durable press finished fabric itself.

In accordance with the treatment process of the present invention, the silicone compound is applied to a textile material containing cellulosic fibers and the textile material is then subjected to appropriate conditions to react and crosslink the silicone compound with the cellulosic fibers of the fabric to impart durable press properties to the fabric. Curing and crosslinking may be carried out by heating in the presence of suitable catalysts or initiators or by other methods such as irradiation.

While silicones have been used heretofore in durable press treatment processes, as noted above, they have been used either as an additives to and in conjunction with other known durable press resins, such as aminoplast resins, or to form a resilient silicone polymer sheath or coating around the fibers. These prior approaches have not used the silicone compounds as a reactive crosslinking agent to react with and crosslink the cellulosic fibers to impart durable press properties to the fabric. The use of silicone compounds as a durable press crosslinking agent in accordance with the present invention provides a number of very significant advantages. In addition to eliminating the use of formaldehyde and the problems and potential hazards associated therewith, fabrics treated by the durable press process of the present invention exhibit very significant improvement in fabric properties as compared to conventional durable press processes. The silicone crosslinks are very flexible as compared to the kind of crosslinks obtained with formaldehyde or aminoplast resins. In addition to having durable press properties, the fabric exhibits enhanced dimensional stability, a more luxurious hand, less embrittlement of the fibers and a greater resistance to abrasion.

Some of the features and advantages of this invention having been described, others will become apparent from the following detailed description of the invention and from the accompanying illustrative examples. It is to be understood, however, that the detailed description and examples which follow are for the purpose of illustrating and more completely describing the present invention and how it may be practiced. Persons skilled in the arts applicable to the present invention will be enabled by this disclosure to produce products and practice methods which embody the present invention and yet take forms which may differ from those here particularly described. Accordingly, the description which follows is to be understood broadly as an enabling disclosure directed to persons skilled in the appropriate arts, and is not to be taken as being restrictive upon the scope of the present invention.

DETAILED DESCRIPTION OF THE INVENTION

The textile materials to which the durable press treatment process of the present invention may be applied may include woven, knitted or nonwoven textile fabrics formed either partially or wholly of cellulosic fibers. Cellulosic fibers that may be treated by the process of the present invention include cotton, jute, flax, rayon, cellulose acetate, and blends of such cellulose fibers with synthetic fibers such as nylon, acrylic, and polyester for example.

Silicone compounds suitable for use in the present invention may be selected from the group consisting of non-functional or functional monomeric or polymeric siloxane compounds. These compounds, under appropriate curing conditions as described more fully herein, can be caused to react with and crosslink the cellulose fibers to impart durable press properties to the fabric. Tests carried out on fabrics treated in accordance with the present invention have confirmed that the silicone compound actually reacts with the cellulose hydroxyls to crosslink the cellulose, and that the durable press properties are thus provided by crosslinking rather than by other mechanisms.

While not wishing to be bound by any particular theory of the mechanism which occurs in producing the durable press properties in accordance with the present invention, it is believed that under the conditions of curing, cleavage of the silicone compound occurs producing highly reactive segments which react with the cellulose fibers to form crosslinks which impart the durable press properties to the fabric. Where the silicone compound contains reactive functional groups, these reactive functional groups may also contribute to the crosslinking.

A preferred class of siloxane compounds for use in the present invention has a siloxane backbone characterized as follows:

$$Q_wT_xD_yM_z$$

where:

w=0–10,000
x=0–10,000
y=0–10,000
z=0–10,000 and wherein:

The M unit represents a trimethyl siloxane end group of the empirical formula $$Me_3SiO_{\frac{1}{2}},$$

the D unit represents a linear dimethyl siloxane group of the empirical formula $$Me_2SiO,$$

and the T unit represents a branched siloxane group of the empirical formula $$MeSiO_{1\frac{1}{2}}.$$

the Q unit represents a branched siloxane group of the empirical formula $SiO_2$.

Siloxane compounds as characterized above may also include any combination of functionalized siloxane groups (denoted as T', D', or M') and containing reactive functionalities of the formula $$-(CH_2)_nX$$

where:

n=0 to 100; and

X=carboxy-; carbethoxy-; halo-; phenyl-; hydroxy-; epoxy-; methoxy-; allyl-; hydrogen-; acetoxy-; vinyl-; and amino-.

Examples of siloxane compounds within the above class include the following: $D_4$, $D_5$, M'M', M'$D'_2$M', M$D'_4$M, M$D_3D'_3$M, M'$D_8$D'M', M$D_8D'_3$M, M$D_{20}D'_3$M, T$D_{20}M'_3$, and T$D_8M'_3$ and wherein the functionalized siloxane group (T', D' or M') contains reactive functionalities as described above.

Nonfunctional and functional siloxanes as characterized above may be monomeric, oligomeric or polymeric and either linear, branched or cyclic.

Examples of polymeric siloxane compounds include nonfunctional and organofunctional polysiloxanes including dimethylpolysiloxanes, methylhydrogen polysiloxanes, methylalkyl polysiloxanes methylaryl polysiloxanes, methylfluoroalkyl polysiloxanes, and organofunctional methylpolysiloxanes such as aminoalkylmethyl polysiloxane, cyanoalkylmethyl polysiloxane, haloalkylmethyl polysiloxane, and vinylmethyl polysiloxane.

Examples of monomeric or oligomeric siloxanes include $MeOSi(Me)_2OMe$, $Me_3SiOMe$, $Me_2Si(OMe)_2$, $Si(OMe)_4$, $Si(OEt)_4$, $MeSi(Me)_2OSi(Me)_2Me$, HOO-C—$(CH_2)_3$—$Si(Me)_2$—O—$Si(Me)_2$—$(CH_2)_3$—COOH.

Cyclic siloxane oligomers are also attractive for use in the present invention, as these compounds have relatively high boiling points and cleave relatively easily under curing conditions to produce reactive segments for crosslinking with cellulose or for polymerization with other reactive silane segments. Examples of cyclic siloxane oligomers include octamethylcyclotetrasiloxane and decamethylcyclopentasiloxane.

The silicone compound may be applied to the textile material by methods conventionally used in durable press finishing operations. For example, a durable press finishing bath containing a solution, dispersion or emulsion of the silicone compound, together with a suitable catalyst and other additives such as emulsifying agents or wetting agents may be applied to the textile material by suitable methods such as by dipping, padding, spraying or printing. After application, the fabric is dried and cured.

Curing of the silicone compound on the fabric may be accomplished in any of several ways. One such method involves incorporation of suitable catalysts in the finishing bath, with curing and crosslinking being accomplished by application of heat. Both acid and alkaline catalysts have been suitably employed. Examples of suitable acid catalysts include magnesium chloride, zirconium oxychloride, antimony trichloride, sulfonic acids and ammonia capped sulfonic acids. A preferred class of acid catalyst for use with the present invention are Lewis acid catalysts, examples of which include aluminum halides, titanium tetrachloride, and alkyltitanates such as butyl titanate. Catalysis of the siloxane compounds may also be accomplished using alkaline materials, such as caustic soda. Peroxides or other free radical initiators may also be used as catalysts in the finishing bath for effecting curing and crosslinking of functional and nonfunctional siloxane compounds.

Effective results may also be achieved by steaming the impregnated fabric after padding and prior to curing. Steaming in the presence of acid or alkaline catalysts effects cleavage of the siloxane and thereby facilitates reaction and crosslinking of the siloxane segments with the cellulose. Typically, the steaming may be carried out for several seconds to several (e.g. 10) minutes, followed by drying and curing or by rinsing, drying and curing.

Curing and crosslinking of the silicone durable press finishing agent may be suitably carried out under conditions similar to those used in the curing of conventional aminoplast resin durable press finishing agents. For example, the impregnated textile material may be directed through a heated oven at a temperature of about 250° to 450° F. for a period of time ranging from about 5 seconds to about 10 minutes. Curing and crosslinking may also be carried out by other methods, such as by irradiation of the impregnated fabric (with or without the presence of catalysts or initiators) using an actinic radiation source such as UV or electron beam.

The finish bath may also contain other conventional pad bath additives such as wetting agents, emulsifying agents, etc.

A typical silicone durable press finish bath suitable for use in the present invention may contain the following:

Silicone fluid—3%
Catalyst—1-10%
Wetting agent—0.5%

As earlier noted, it has been determined that when the silicone compound is applied to the fabric and cured in the manner described, the silicone compound actually reacts and crosslinks the cellulose to provide durable press properties to the fabric. A test method which has been suitably employed for confirming whether crosslinking occurs on the cellulose involves dyeing the fabric using a relatively large dye molecule. An example of a suitable dye for conducting such tests is SOL-AQUA-FAST-RED-2BL produced by Crompton and Knowles Corporation. The dye molecule penetrates an uncrosslinked structure relatively easily, but has difficulty penetrating a tightly crosslinked structure. Thus the degree of crosslinking will be evidenced by the color of the test samples. The following example describes a dyeing test carried out on fabric samples treated in accordance with the present invention.

EXAMPLE 1

Identical fabric samples were treated by the silicone durable press process of the present invention and with a conventional glyoxal resin durable press finish. A similar fabric sample was also treated with the silicone durable press formulation of the present invention but with the catalyst omitted. These samples, and an unfinished control sample were boiled in a solution of dye (SOL-AQUA-FAST RED 2BL by Crompton and Knowles Corporation) for approximately ten minutes. The samples were then removed from the dye and dried, and the following results were observed:

DP Resin Control-Slightly Pink
Unfinished Control-Dark Pink
Silicone Without Catalyst-Dark Pink
Silicone With Catalyst-Medium Pink The unfinished control and the sample treated with silicone without catalyst showed a similar dark pink color indicating that no cross-linking occurred. The sample treated with a conventional durable press resin evidenced a slightly pink color indicating a relatively high degree of cross-linking. The sample treated with the silicone formulation of the present invention with catalyst showed a medium pink color indicating that cross-linking occurred, but to a lesser extent than with the DP resin control.

The following non-limiting examples illustrate various finishing bath formulations in accordance with the invention and how they may be applied and cured.

EXAMPLE 2

Samples of a polyester/cotton blend woven fabric were padded to a wet pickup of 50% with finishing formulations as follows:

| Chemicals (g/l.) | A | B | C | D |
|---|---|---|---|---|
| Silicone 1* | — | — | — | 60 |
| Silicone 2* | 40 | 40 | — | — |
| Silicone 3* | — | — | 60 | — |
| surfactant | .5 | .5 | .5 | .5 |
| $MgCl_2$ catalyst | 10 | — | 10 | 10 |
| $SbCl_3$ catalyst | — | .2 | — | — |

*Silicone 1 = 60% emulsion of 1200 cs silicone fluid
Silicone 2 = 50% emulsion of 1000 cs silicone fluid
Silicone 3 = 50% emulsion of 350 cs silicone fluid The fabrics were dried at 250° F. for one minute and cured at 400° F. for 20 seconds. The fabrics exhibited a 3.5 durable press rating after one and five home washings and exhibited acceptable shrinkage.

EXAMPLE 3

A polyester/cotton blend woven fabric is padded to a wet pickup of 60% with an aqueous finishing formulation containing 60 g/l. of Dow Corning 193 silicone (a water soluble silicone glycol copolymer) and 0.4 g/l. of aluminum chloride catalyst. The fabric is dried at 250° F. for one minute and cured at 400° F. for 20 seconds. The fabrics exhibited significantly improved durable press and shrinkage ratings compared to untreated specimens.

EXAMPLE 4

Example 2 is repeated using an aqueous finishing formulation as follows: 120 g/l. SM2061 silicone (a 35% emulsion of a 60,000 cs silicone oil), 20 g/l. magnesium chloride catalyst, 1 g/l. catalyst (20% $AlCl_3.6H_2O$+hydroxy acid) and 1 g/l. Springswet wetting agent. The fabric is dried at 250° F. for one minute and cured at 300° F. for 5 minutes. The fabrics showed improved durable press and shrinkage ratings.

EXAMPLE 5

Silicone polymers were cured on a textile fabric by free radical grafting of the methyl groups to form a crosslinked durable polymer. Fabrics were padded with finishing formulations as follows; followed by drying and curing as indicated.

| | E | F | G | H |
|---|---|---|---|---|
| Chemicals (g/l.) | | | | |
| 35% 350 cs polydimethylsiloxane | 230 | — | 230 | 230 |
| 35% 10,000 cs polydimethylsiloxne | — | 230 | — | — |
| benzoyl peroxide | 10 | 10 | 10 | — |
| hydrogen peroxide | — | — | — | 10 |
| Conditions | | | | |
| dry (°F.) | 250 | 250 | none | none |
| cure (°F.) | 400 | 400 | 400 | 400 |
| cure time (sec) | 20 | 20 | 20 | 20 |

The fabrics showed improved durable press and shrinkage ratings.

EXAMPLE 6

Silicone polymers were cured on a textile fabric with the use of alkaline catalysis to form a crosslinked durable polymer. The fabric was padded with a finishing formulation as follows:

| | I | J | K | L | M | N | O |
|---|---|---|---|---|---|---|---|
| Chemicals (g/l.) | | | | | | | |
| GE SM 2061 silicone | 40 | 40 | 40 | 40 | 40 | 40 | 40 |
| 50% caustic | 50 | 100 | 50 | 100 | 50 | 100 | 100 |
| Springswet | 1 | 1 | 1 | 1 | 1 | 1 | 1 |

The fabrics were then optionally steamed and rinsed, followed by drying and curing as follows:

| | | | | | | | |
|---|---|---|---|---|---|---|---|
| Conditions | | | | | | | |
| wet pick up | 60% | 60% | 60% | 60% | 60% | 60% | 60% |
| steam (minutes) | — | 1 | 1 | 1 | 1 | 5 | 5 |
| rinse | no | no | no | yes | yes | no | yes |
| dry (°F.) | 250 | 250 | 250 | 250 | 250 | 250 | 250 |
| cure (°F.) | 400 | 400 | 400 | 400 | 400 | 400 | 400 |
| cure time (sec) | 20 | 20 | 20 | 20 | 20 | 20 | 20 |

The fabrics exhibited discoloration after curing, but after subsequent washing the discoloration washed out. The fabrics had improved durable press and shrinkage ratings.

EXAMPLE 7

Example 6 was repeated using a finishing formulation containing a Lewis acid catalyst, as follows:

| | P | Q | R |
|---|---|---|---|
| GE SM 2061 silicone | 40 | 40 | 40 |
| $ALCL_3.6H_2O$ | 0.3 | 1.0 | 2.0 |
| magnesium chloride | 13 | 13 | 13 |
| Springswet | 1 | 1 | 1 |

The fabric was padded to a wet pick up of 60%, followed by steaming 5 minutes, rinsing, drying at 250° F., and curing at 400° F. Fabric samples were also dried and cured as usual without rinsing and steaming. No color problems were observed, and the fabrics had improved durable press and shrinkage ratings.

EXAMPLE 8

Finishing formulations containing 60% emulsions of $D_4$ and $D_5$ silicone polymers were cured on a textile fabric, as follows:

| Chemicals (g/l) | S | T | U | V |
|---|---|---|---|---|
| siloxane (D5) | 25 | 25 | — | — |
| siloxane (D4) | — | — | 25 | 25 |

-continued

| Chemicals (g/l) | S | T | U | V |
|---|---|---|---|---|
| magnesium chloride | 15 | 13 | 15 | 13 |
| Springswet | 1 | 1 | 1 | 1 |
| $AlCl_3.6H_2O$ soln.(1 g/10 ml) | — | 3 | — | 3 |

The fabrics were padded at 60% wet pick up, dried at 250° F./30 seconds, and cured at 400° F./20 seconds. All fabric samples cured without discoloration, and showed improved durable press and shrinkage ratings.

EXAMPLE 9

Silicone polymers were applied to a polyester cotton blend woven fabric and cured by electron beam irradiation, using the following formulations:

| Chemicals (g/l) | 1 | 1a | 2 | 2a | 3 | 3a | 4 | 4a | 5 | 5a | 6 | 6a |
|---|---|---|---|---|---|---|---|---|---|---|---|---|
| Silicone 1* | 40 | 40 | — | — | — | — | — | — | — | — | — | — |
| Silicone 2* | — | — | 28 | 28 | — | — | — | — | — | — | — | — |
| Silicone 3* | — | — | — | — | 56 | 56 | — | — | — | — | — | — |
| Silicone 4* | — | — | — | — | — | — | 56 | 56 | — | — | — | — |
| Silicone 5* | — | — | — | — | — | — | — | — | 56 | 56 | — | — |
| Silicone 6* | — | — | — | — | — | — | — | — | — | — | 56 | 56 |
| magnesium chloride | 13 | — | 13 | — | 13 | — | 13 | — | 13 | — | 13 | — |
| $AlCl_3.6H_2O$ | 2 | — | 2 | — | 2 | — | 2 | — | 2 | — | 2 | — |
| Springswet | 1 | 1 | 1 | 1 | 1 | 1 | 1 | 1 | 1 | 1 | 1 | 1 |

*Silicone 1 - 60,000 centistoke nonfunctional dimethylpolysiloxane

Silicone 2 - 5 centistoke nonfunctional dimethylpolysiloxane

Silicone 3 - low m.w. functional branched fluid $TD_{20}M'_3$ where $M'_3 = \begin{array}{c} CH_3 \\ | \\ Si-(CH_2)_3-OH \\ | \\ CH_3 \end{array}$ Silicone 4 - low m.w. functional branched fluid $TD_{20}M'_3$ where $M'_3 = \begin{array}{c} CH_3 \\ | \\ Si-(CH_2)_3-COOH \\ | \\ CH_3 \end{array}$ Silicone 5 - low m.w. functional branched fluid $TD_{20}M'_3$ where $M'_3 = \begin{array}{c} CH_3 \\ | \\ -Si-H \\ | \\ CH_3 \end{array}$ Silicone 6 - low m.w. functional branched fluid $TD_{20}'_3$ where $M'_3 = \begin{array}{c} CH_3 \\ | \\ -Si-CH_3 \\ | \\ CH_3 \end{array}$ Fabric samples were padded to a wet pick up of about 60 percent, dried at 250° F./30 seconds; and then irradiated by electron beam radiation at levels of 0, 5, 10 and 20 m Rad. One set of samples was examined following irradiation only, while another set of samples were cured at 400° F. for 20 seconds. It was observed that the irradiated samples were cured. Shrinkage tests and durable press tests showed that the shrinkage decreases with increased irradiation, and the samples with catalysts exhibited a better cure, generally.

That which is claimed is:

1. A process of treating textile materials containing cellulosic fibers to provide durable press properties, said process comprising impregnating the material with a durable press finishing agent consisting essentially of a siloxane compound, drying the impregnated material, and irradiating the material with actinic radiation to react and crosslink the siloxane compound with the cellulosic fibers to impart said durable press properties to the fabric.

2. A process as set forth in claim 1 including the further step of heating the irradiated fabric to further cure and crosslink the siloxane compound with the cellulosic fibers.

3. A process as set forth in claim 1 wherein said durable press finishing agent also includes a catalyst.

4. A durable press textile material produced by the process of claim 1.

5. A durable press textile material produced by the process of claim 2.

6. A durable press textile material produced by the process of claim 3.

* * * * *

UNITED STATES PATENT AND TRADEMARK OFFICE

CERTIFICATE OF CORRECTION

PATENT NO. : 4,549,880

DATED : October 29, 1985

INVENTOR(S) : James Easton Hendrix, John Yaden Daniels, Taryn Morgan White

It is certified that error appears in the above-identified patent and that said Letters Patent is hereby corrected as shown below:

Column 8, line 44, "$TD_{20}'_3$" should be -- $TD_{20}M'_3$ --.

Signed and Sealed this

Sixteenth Day of September 1986

[SEAL]

Attest:

DONALD J. QUIGG

Attesting Officer

Commissioner of Patents and Trademarks